United States Patent [19]

Lanfermann

[11] 4,067,620

[45] Jan. 10, 1978

[54] RACK-DRIVEN MINING MACHINE WITH PIVOTAL GUIDE SHOE

[75] Inventor: Willy Lanfermann, Bochum, Germany

[73] Assignee: Gebr. Eickhoff, Maschinenfabrik und Eisengiesserei m.b.H., Bochum, Germany

[21] Appl. No.: 738,573

[22] Filed: Nov. 3, 1976

[30] Foreign Application Priority Data

Nov. 20, 1975 Germany ..... 2552085

[51] Int. Cl.[2] ..... E21C 29/22

[52] U.S. Cl. ..... 299/43

[58] Field of Search ..... 299/32–34, 299/42–44

[56] References Cited

U.S. PATENT DOCUMENTS

| | | | |
|---|---|---|---|
| 1,711,280 | 4/1929 | Morgan | 299/42 X |
| 4,006,937 | 2/1977 | Curtis | 299/43 |

FOREIGN PATENT DOCUMENTS

| | | | |
|---|---|---|---|
| 2,547,826 | 4/1976 | Germany | 299/43 |
| 1,265,171 | 3/1972 | United Kingdom | 299/42 |

*Primary Examiner*—Ernest R. Purser

*Attorney, Agent, or Firm*—Thomas H. Murray

[57] ABSTRACT

Described is a mining machine of the type which moves along a track or conveyor provided with a gear rack and wherein a driven gearwheel on the machine engages the rack to move the machine along the track. At least one skid is pivotally connected to the mining machine and bears upon and is guided by the rack, the pivotal connection of the skid to the machine being intermediate the ends of the skid. The gearwheel is fixedly mounted on the mining machine and extends through an opening in the skid to mesh with the gear rack whereby rotation of the gearwheel will cause the machine to traverse the track. The axis of rotation of the gearwheel lies in a vertical plane through which the pivotal axis of the skid extends whereby the skid can articulate along the rack without affecting the engagement of the gearwheel with the rack.

7 Claims, 5 Drawing Figures

RACK-DRIVEN MINING MACHINE WITH PIVOTAL GUIDE SHOE

BACKGROUND OF THE INVENTION

While not limited thereto, the present invention is particularly adapted for use with longwall mining machines and coal plows. In the mining of coal veins by the longwall mining method, a cutting machine is employed that cuts along the longwall face of the coal seam while moving longitudinally along the longwall face on a conveyor or track spaced therefrom. A suitable cutting machine for performing this operation usually consists of a machine body movable along the conveyor, and one or more support arms pivotally attached to the body and carrying rotating cutting tools.

A longwall mining machine of this type can be advanced by means of a winch arrangement comprising a chain wheel which is in engagement with a chain looped about a guide wheel and anchored at its opposite ends to the ends of the longwall face. With this arrangement, rotation of the chain wheel by a drive motor will cause the mining machine to advance along the track on which it is mounted. In other cases, however, movement of the mining machine along the face being mined is achieved by means of a gearwheel on the mining machine which engages a rack extending along the track. Such mining machines are shown, for example, in U.S. Pat. Nos. 1,710,801 and 1,638,507.

In a rack-driven mining machine of the type described above, it is difficult to produce the forward thrust required for a mining operation. These difficulties are due mainly to the undulating, uneven mine floor which impairs meshing of the driving gearwheel with the teeth of the gear rack. This is particularly true in the case of long mining machines where the undulating condition of the floor impedes the transmission of substantial thrust forces.

SUMMARY OF THE INVENTION

In accordance with the present invention, a new and improved propelling system for a longwall mining machine is provided utilizing a rack and driving gearwheel arrangement which facilitates good meshing engagement of the gearwheel with the rack under all mine floor conditions and enables the generation of particularly large forward thrust forces.

In carrying out the invention, the driving gearwheel which engages the aforesaid rack extends through an opening in a skid which bears upon the rack and which is pivotally connected to the mining machine along an axis which extends through the axis of rotation of the driving gearwheel. In this manner, and since the skid constantly bears on the rack even in the case of undulating floors, the distance between the rack and the axis of the driving gearwheel will always remain constant, or substantially constant.

Consequently, the teeth of the gearwheel mesh with the rack throughout their entire depths and are capable of transmitting large driving forces which produce the desired forward thrust. It is advantageous if the mining machine is directly supported and guided on the rack by means of the skids. In this way, the skids improve the retention of the driving wheel in the rack geeth and changes in the distance between the axis of rotation of the driving gearwheel and the teeth of the rack are avoided.

In a preferred embodiment of the invention, skids of the type described above are provided on opposite ends of the mining machine and each is provided with a driving gearwheel. The gearwheels, in turn, are driven by fluid motors connected in parallel to a winch pump. Due to the parallel connection of the fluid motors acting on the driving gearwheels which are spatially separated from each other, the load is divided between the two driving gearwheels; and the desired large forward thrust can be produced even when one or both of the gearwheels does not completely mesh with the gear rack.

The mining machine frame is conveniently provided in the region of its two skids with detachably-disposed axial journals for supporting the driving gearwheels that mesh with the gear rack. Detachably-disposed axial journals also support the intermediate gears between the fluid drive motors and the gearwheels which engage the rack. This facilitates easy replacement of the wheel gears.

A further improvement of tooth engagement between the gearwheel and its associated rack is achieved by securing the gearwheel on shaft journals by means of adjustable bearings. The adjustable bearings improve the contact pattern of the driving gear system and linear contact between gear teeth and the rack is achieved even if the axis of rotation of the driving gearwheel is not exactly parallel to the horizontal plane through which the rack extends.

Advantageously, the driving gearwheel meshes with the gear rack through an opening in an associated skid. The driving gearwheel is then positioned in a substantially protected position within the skid and is covered in the region in which it engages the rack. Wipers of resilient material are provided at opposite ends of each skid to clear the rack of debris.

The above and other objects and features of the invention will become apparent from the following detailed description taken in connection with the accompanying drawings, in which.

Figure 1:
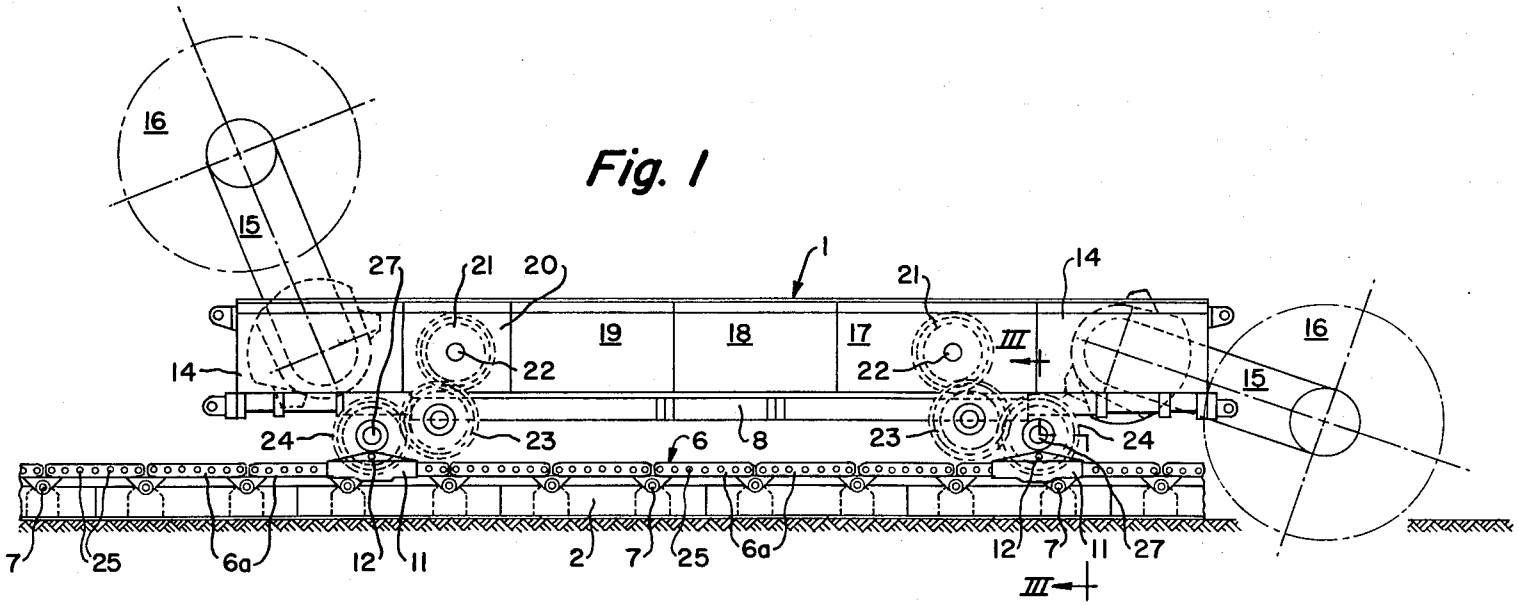
FIG. 1 is a side elevational view of a doubledrum, longwall mining machine incorporating the features of the invention.
Figure 2:
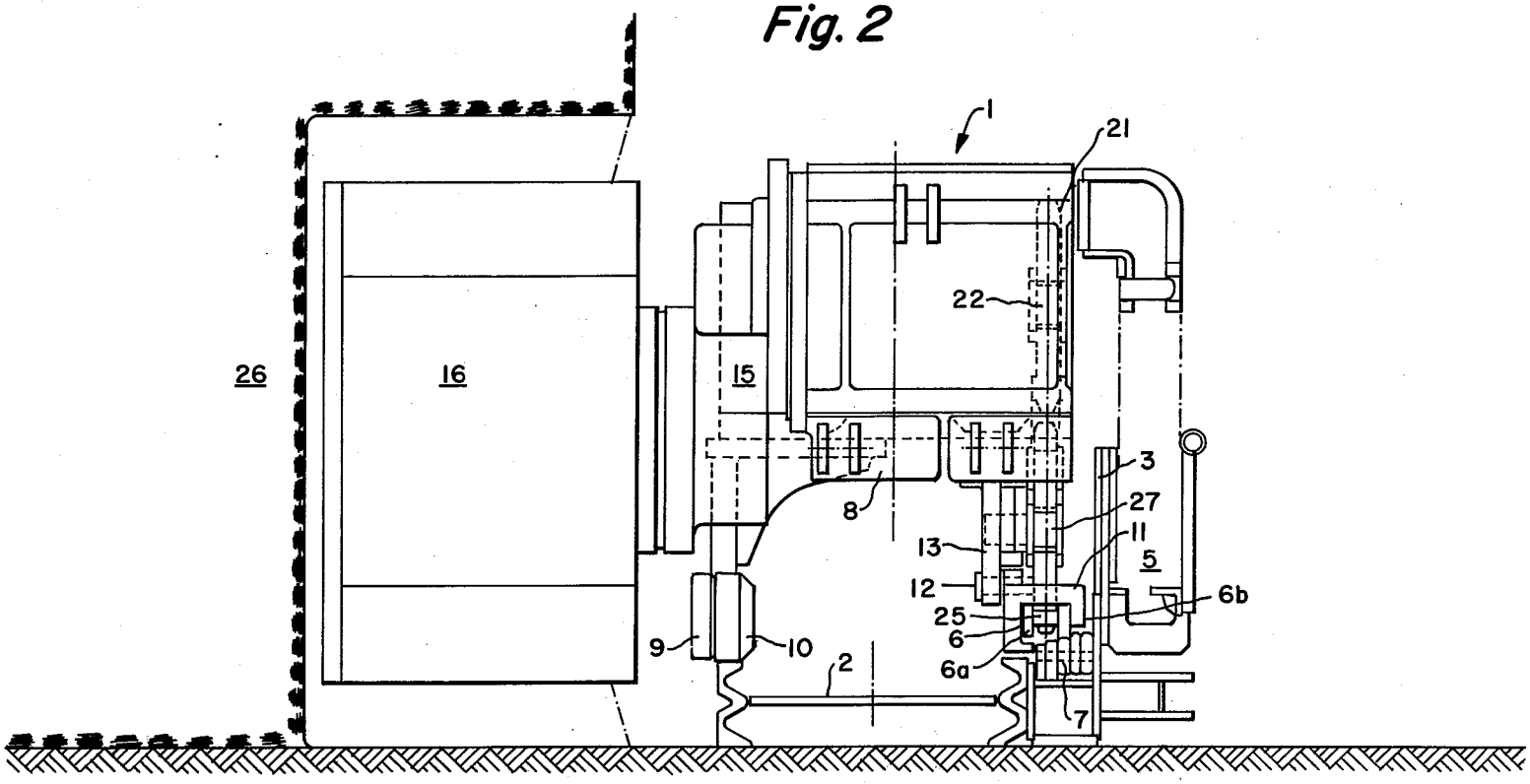
FIG. 2 is an elevational view of the machine shown in FIG. 1.

With reference now to the drawings, and particularly to FIGS. 1 and 2, the longwall mining machine itself is identified generally by the reference numeral 1. The mining machine travels along a face conveyor or track 2 and supports a side bracket 3 (FIG. 2) on the stowing side of the machine. The bracket 3, in turn, carries a channel 5 which is open at the top to accommodate an electrical supply cable for the mining machine, not shown.

Figure 4:
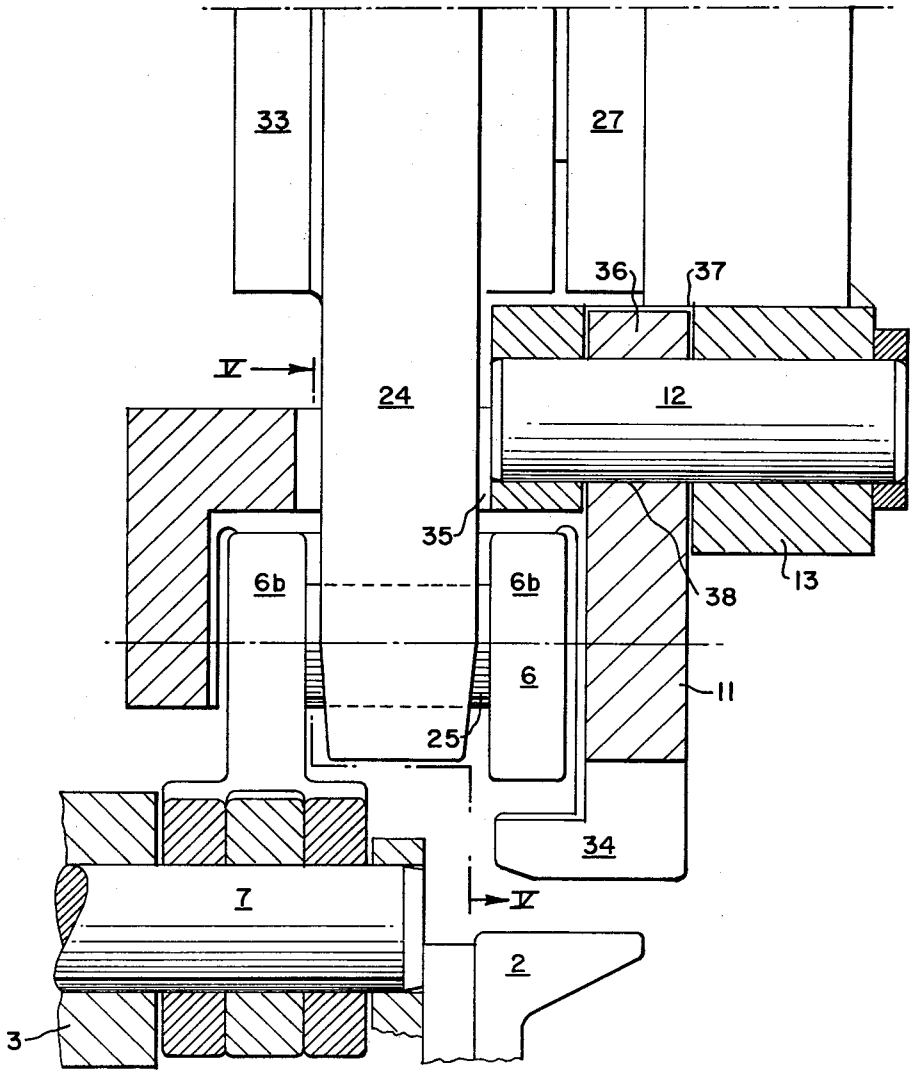
FIG. 4 is a cross-sectional view taken along line IV—IV of FIG. 5 showing the manner in which the driving gearwheel engages the drive rack of the invention.

A gear rack 6, divided into individual sections **6*a*, is located between the face conveyor or track 2 and the side bracket 3. The conveyor 2 is divided into trough portions connected end-to-end; the lengths of the individual portions 6*a* corresponding to half the length of each trough portion of the conveyor assembly. Furthermore, each of the rack portions 6a is offset by half its length with respect to the joints of the conveyor trough portions and is pivotally connected to adjacent rack portions and to the side bracket 3 by means of bolts 7 extending transverse to the longitudinal extent of the conveyor 2 (See FIG. 4). Each end of the frame 8 of the machine 1 is provided with a skid 9 on the working face side of the machine, the skid bearing by means of a roller 10 on the conveyor 2 when the machine moves to the right or left as viewed in FIG. 1. Each end of the frame 8 on the stowing side of the machine is also provided with a skid 11, each skid being pivotally mounted on bolts 12 carried on frame shoulders 13 (See FIG. 4). Bolts 12 also extend transversely to the longitudinal extent of the conveyor 2. As best shown in FIG. 4, both skids 11 on the stowing side of the machine surround the rack 6 which is situated between the side bracket 3 and the conveyor 2. The skids 11 bear on, and are supported by, the rack 6 and guide the mining machine 1 as it traverses the conveyor 2**.

As is best shown in FIG. 1, the body of the mining machine 1 is formed from individual modules. These include two cutter heads 14 on opposite ends of the machine, each cutter head including a pivotal support arm 15 and a cutter drum 16 which is supported on the end of the arm 15. Another module 17 comprises a winch; and next to the winch is a driving motor 18. An intermediate module 19 is provided for the power line and control elements of the mining machine. All of the modules are flange-mounted upon each other to form a rigid body which bears on the frame 8 and is connected thereto. The winch module 17 incorporates a fluid circuit, not shown, comprising a fluid pump and a fluid motor. A second fluid motor in module 20 is connected in parallel to the fluid pump. Each of the two fluid motors is provided with a gear 21 carried on a shaft 22. The rotating motion of the two fluid motors is transmitted through gears 21 and 23 to each of the gearwheels 24 which mesh with the rack 6.

As shown in FIG. 4, the rack 6 includes side members 6b rigidly joined to each other by cross-shafts 25. The teeth of the two driving gearwheels 24 engage successive ones of the shafts 25 on the rack 26 and propel the mining machine along the track 2.

Figure 3:
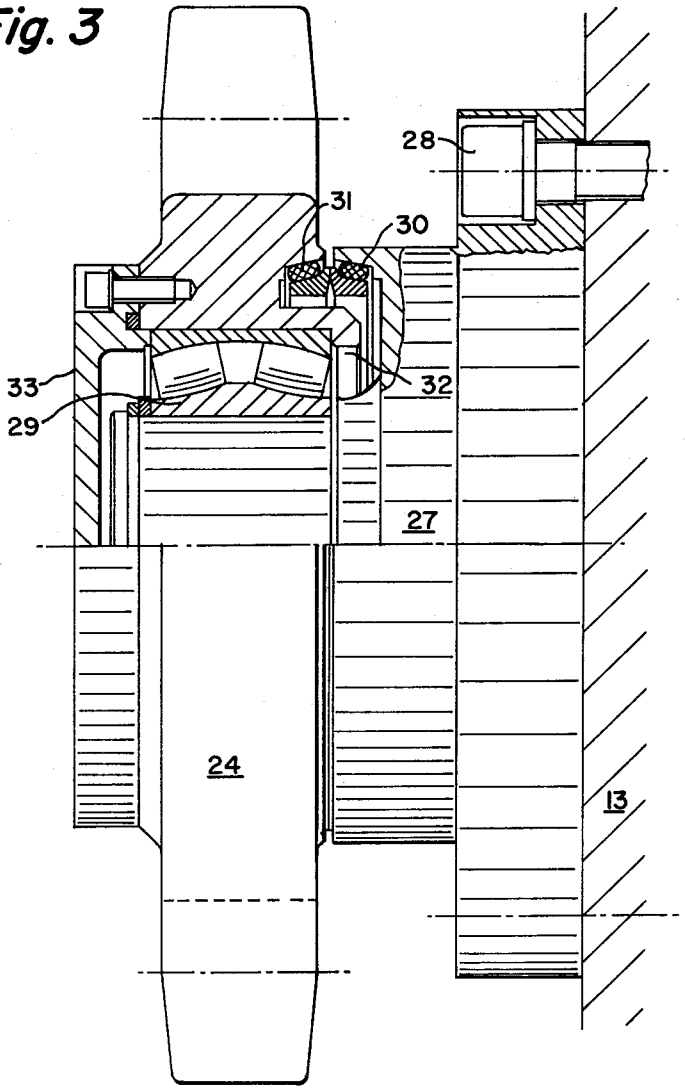
FIG. 3 is a view taken substantially along line III—III of FIG. 1 showing one of the driving gearwheels of the invention in partial section.

With reference to FIG. 3, it can be seen that the gearwheels 24 are rotatably supported on shaft journals 27 which are detachably mounted on the machine frame by means of screw fasteners 28. The same is true of gears 23. It can be seen that the gearwheel 24 is mounted on the frame shoulder 13 previously described. Each driving gearwheel 24 is supported by a self-aligning tapered roller bearing 29. The gearwheels, therefore, can adjust themselves over a limited range with respect to their axes of rotation such that their teeth flanks make contact over the entire width of the cross-shafts 25. Annular gaskets 30 and 31 surround the shaft journals 27 to provide a seal on one side of each gearwheel 24; while a cap 33 protects the bearings on the other side of the gearwheel.

Since the fluid motors driving the gearwheels 24 are connected in parallel to the same fluid pump, they engage the rack with approximately identical tooth pressures. The gearwheels 24 are situated directly above the skids 11 on the stowing side of the machine (FIG. 5) so that engagement of the two driving gearwheels 24 with the cross-shafts 25 cannot be impaired by irregularities of the floor or by an undulating floor. The axes of the shaft journals 27 are situated in a common vertical plane with the bolts 12 which pivotally connect the skids 11 to the frame shoulder 13. Since the skids 11 are positively connected to the rack 6 by virtue of flanges 34 which extend under the rack, the gearwheels 24 maintain constant contact with the teeth or cross-shafts 25 of the rack and this engagement is not endangered even on an uneven floor.

The longwall mining machine illustrated in FIGS. 1 and 2 can, of course, traverse along the working face 26 shown in FIG. 2 with only a single driving gearwheel 24 if this is permitted by the conditions of the seam being mined. In this case, not only the module 20 but also the intermediate gear 23 and one of the driving gearwheels 24 will be omitted. The machine frame 8 which is also constructed in module form can be adapted for machines of different lengths. It is possible to attach the rack 6 on the stowing side and/or on the working face side of the machine and to equip the mining machine with correspondingly-arranged driving gearwheels 24.

Figure 5:
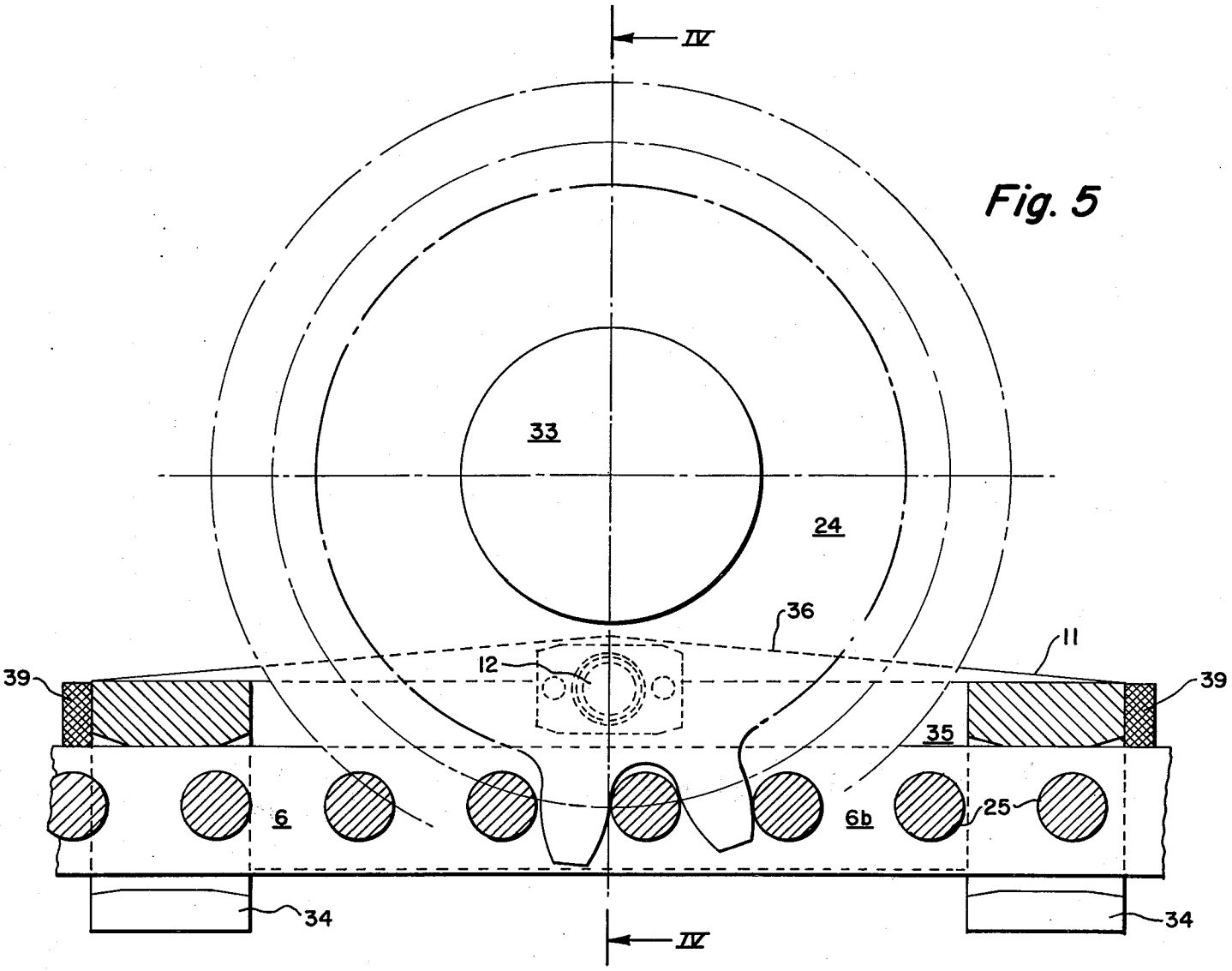
FIG. 5 is a cross-sectional view taken along line V—V of FIG. 4.

The skids 11 on the stowing side are shown in sectional form in FIGS. 4 and 5. These skids grip beneath the rack 6 by means of flanges 34 and are provided with an opening 35 through which the driving gearwheel 24 meshes from above with the cross-shafts 25 of the rack 6. Both skids 11 guide the mining machine in the vertical and in the horizontal directions and are carried in slots 37 in the frame shoulder 13. In this respect, the bolts 12 which extend transversely to the mining machine extend through the frame shoulder 13 and through a bore 38 in a flange 36 on the skid. The bolt 12 is situated in a common vertical plane with the shaft journal 27 of the gearwheel 24. As a result, pivotal movement of the skid with respect to the bolt 12 will not affect the meshing engagement of the gearwheel 24 with the rack. Strippers 39 (FIG. 5), which consist of resilient material such as rubber or plastic, are mounted on both end faces of the skids and slide on the rack 60 so that the top rack surface which functions as a traveling path for the skids is kept free of debris.

Although the invention has been shown in connection with certain specific embodiments, it will be readily apparent to those skilled in the art that various changes in form and arrangement of parts may be made to suit requirements without departing from the spirit and scope of the invention.

I claim as an invention:

1. In a mining machine of the type which moves along a track provided with a gear rack and wherein a driven gear on the machine engages the rack to move the machine along the track, the improvement comprising a skid bearing upon and guided by said rack, the skid being pivotally connected to said mining machine intermediate the ends of the skid about an axis extending transverse to the path of travel of the machine, and a gearwheel fixedly mounted on said mining machine and meshing with said gear rack whereby rotation of the gearwheel will cause the machine to traverse the track, the axis of rotation of the gearwheel lying in a substantially vertical plane through which the pivotal axis of said skid extends whereby pivotal movement of the skid with respect to its pivotal connection to the mining machine will not affect the meshing engagement of the gearwheel with said gear rack.

2. The improvement of claim 1 wherein a skid and a gearwheel are provided at each end of said mining machine.

3. The improvement of claim 2 including a fluid motor for driving each of said gearwheels, and a single fluid pump connected in parallel to both of said fluid motors.

4. The improvement of claim 1 wherein said gearwheel is carried on a detachably-disposed shaft journal secured to the mining machine.

5. The improvement of claim 1 wherein said gearwheel is journaled in an adjustable bearing.

6. The improvement of claim 1 wherein said skid is provided with an opening through which said gearwheel extends to engage said gear rack.

7. The improvement of claim 1 wherein said skid is provided at its opposite ends with strippers which slide on and remove debris from said gear rack.

* * * * *